US011920614B2

(12) United States Patent
Ying

(10) Patent No.: US 11,920,614 B2
(45) Date of Patent: Mar. 5, 2024

(54) FAN

(71) Applicant: Hui Ying, Yongkang (CN)

(72) Inventor: Hui Ying, Yongkang (CN)

(73) Assignee: Hui Ying, Yongkang (CN)

( * ) Notice: Subject to any disclaimer, the term of this patent is extended or adjusted under 35 U.S.C. 154(b) by 0 days.

(21) Appl. No.: 17/756,145

(22) PCT Filed: Nov. 13, 2020

(86) PCT No.: PCT/CN2020/128630
§ 371 (c)(1),
(2) Date: May 18, 2022

(87) PCT Pub. No.: WO2021/098599
PCT Pub. Date: May 27, 2021

(65) Prior Publication Data

US 2022/0397125 A1 Dec. 15, 2022

(30) Foreign Application Priority Data

Nov. 18, 2019 (CN) ..... 201911130114.7
Nov. 18, 2019 (CN) ..... 201921992588.8

(51) Int. Cl.
*F04F 5/16* (2006.01)
*F04D 25/08* (2006.01)

(52) U.S. Cl.
CPC ..... *F04F 5/16* (2013.01); *F04D 25/08* (2013.01)

(58) Field of Classification Search
CPC ..... F04D 17/06; F04D 17/16; F04D 17/165; F04D 19/002; F04D 25/0606;
(Continued)

(56) References Cited

U.S. PATENT DOCUMENTS

2010/0226769 A1* 9/2010 Helps ..... F04D 25/08 415/208.1
2010/0226787 A1* 9/2010 Gammack ..... F24F 13/32 416/246
2012/0114513 A1* 5/2012 Simmonds ..... F04D 25/08 137/833

FOREIGN PATENT DOCUMENTS

CN 202091268 U 12/2011
CN 202937528 U 5/2013
(Continued)

OTHER PUBLICATIONS

Extended European Search Report dated Nov. 21, 2022 in co-pending European Patent Application No. 20890355.9.
(Continued)

*Primary Examiner* — Alexander B Comley
(74) *Attorney, Agent, or Firm* — Thomas | Horstemeyer, LLP

(57) ABSTRACT

A fan is provided, including: a body including a fan motor unit, which includes an impeller, a motor and an air-output three-way seat and a nozzle connected to an air outlet of the body, wherein the nozzle receives the airflow from the body and emit the airflow, the nozzle includes a nozzle body in a shape of half a frame; the air-output three-way seat includes at least one air inlet, a first air outlet, a second air outlet, and an air-splitting wall body for splitting the airflow passing through the air inlet and then guiding the airflow to the first air outlet and the second air outlet, respectively. The fan changes the moving direction of the airflow therein, and decreases the entire height and volume.

9 Claims, 20 Drawing Sheets

(58) Field of Classification Search
CPC ..... F04D 25/08; F04D 25/166; F04D 29/4206–4253; F04D 29/444; F04D 29/703; F04F 5/16
See application file for complete search history.

(56) References Cited

FOREIGN PATENT DOCUMENTS

| | | | | | |
|---|---|---|---|---|---|
| CN | 203035626 | U | * | 7/2013 | |
| CN | 203035626 | U | | 7/2013 | |
| CN | 203670312 | U | | 6/2014 | |
| CN | 105650743 | A | | 6/2016 | |
| CN | 205478589 | U | | 8/2016 | |
| CN | 106762755 | A | | 5/2017 | |
| CN | 106870422 | A | * | 6/2017 | ..... F04D 25/08 |
| CN | 106870422 | A | | 6/2017 | |
| CN | 109236703 | A | | 1/2019 | |
| CN | 208651295 | U | | 3/2019 | |
| CN | 208749619 | U | | 4/2019 | |
| CN | 110219814 | A | | 9/2019 | |
| CN | 110762060 | A | | 2/2020 | |
| CN | 110762061 | A | | 2/2020 | |
| CN | 110792639 | A | | 2/2020 | |
| CN | 110792640 | A | | 2/2020 | |
| CN | 210949304 | U | | 7/2020 | |
| KR | 101988169 | B1 | | 6/2019 | |
| TW | M419831 | U | | 1/2012 | |

OTHER PUBLICATIONS

International Search Report for PCT Patent Application No. PCT/CN2020/128630 dated Feb. 18, 2021.

* cited by examiner

FAN

CROSS-REFERENCE TO RELATED APPLICATIONS

This application is based upon PCT patent application No. PCT/CN2020/128630, filed on Nov. 13, 2020, which claims priority to Chinese Patent Applications No. 201911130114.7 and 201921992588.8, filed on Nov. 18, 2019, the entire contents of which are incorporated herein by reference.

TECHNICAL FIELD

The present disclosure relates generally to air adjusting equipment, and more particularly to a fan.

BACKGROUND

With the improvement of scientific and technological level, the requirements for high-quality life are also increasing, and indoor air quality has become one of the important indicators that people are concerning. Especially, with the emergence of environmental pollution, such as smog and PM2.5 in recent years, the demand for air purifiers is also increasing.

Air purifiers are small household appliances used to purify indoor air, and they mainly solve indoor air pollution due to decoration or other reasons. Due to the persistence and uncertainty of the release of pollutants in indoor air, purifying indoor air with air purifiers is an internationally recognized method for improving indoor air quality. There are many different technologies and filter media in air purifiers that enable them to provide clean and safe air for the user. Commonly used air purification technologies include low-temperature asymmetric plasma air purification technology, adsorption technology, negative ion technology, negative oxygen ion technology, molecular complex technology, nano-TiO2 technology, high efficiency particulate air filter (HEPA) technology, electrostatic dust collection technology, active oxygen technology, etc.; Filter media related technologies mainly include photo catalysts, activated carbon, synthetic fibers, high-efficiency materials of HEPA, etc. The cost of high-quality filters will account for 20% to 30% of the total cost of air purifiers.

At present, many bladeless fan assemblies with air filters have appeared. FIG. 1 is a cross-sectional view of a bladeless fan in the prior art. As shown in FIG. 1, most of fan assemblies include an annular nozzle 901, a housing 903, a base 904, a filter 905, a fan motor 906 and a mesh inner tank 907. Wherein, the housing 903 with the air-input mesh is arranged on the base 904, the housing 903 is provided with a filter 905, the filter 905 is provided with a mesh inner tank 907, and the mesh inner tank 907 is provided with first air inlets of the fan motor 906. The annular nozzle 901 is located above the housing 903 in the gravity direction, and the air outlet of the fan motor 906 is connected to the nozzle 901. The indoor air is filtered by the meshes of the housing 903 and the filter 905 in sequence, then enters the mesh inner tank 907. Then the airflow is drawn by the fan motor 906 in a direction opposite to the gravity direction, conveyed to one end of the annular nozzle 901 in the direction opposite to the gravity direction (upward vertically), and finally emitted by the annular nozzle 901 to everywhere.

The structure at least has the following technical problems to be solved:

(1) the two biggest parts, the annular nozzle and the fan motor, of the bladeless fan must be arranged at different heights in the gravity direction, the entire height of the bladeless fan is hard to be decreased, the usage scenarios are greatly limited.

(2) the central part of the annular nozzle is hollow and not fully utilized, it's a waste to the entire volume of the fan, and the cost of transporting and storing the product is increased.

(3) as the height of the air inlet of the fan motor is lower, the dust may be easily drawn from the ground when the fan draws the air, the usage load of the filter is enlarged, the filter needs to be replaced more frequently, which will apparently increase the use cost of the bladeless fan.

(4) The housing of the bladeless fan includes two housings engaged with each other in a horizontal direction, each housing is provided with a piece of filter. The filter is sealed by a stereoscopic sealing rubber strip to the mesh inner tank, the stereoscopic sealing rubber strip has a high cost, and the sealing effect will be decreased after a long-time use.

(5) When the filter is replaced, the housings need to be detached and then mounted back after the filters are replaced respectively. The replacing process is complex, and provides a poor user experience.

(6) The product cannot be provided with other functional modules, and is hard to be functionally extended.

SUMMARY

The purpose of the present disclosure is to provide a fan to overcome the difficulty in the prior art. The fan can change the moving direction of the airflow therein, decrease the entire height and volume of the fan, prolong the filter's life, and reduce the use cost of the fan.

In an aspect of the present disclosure, a fan is provided, including:

a body comprising at least one air inlet, at least one air outlet and a fan motor unit for generating an airflow, wherein the fan motor unit comprises an impeller, a motor and an air-output three-way seat; and a nozzle connected to the air outlet of the body, wherein the nozzle is configured to receive the airflow from the body and emit the airflow, the nozzle comprises a nozzle body in a shape of half a frame;

wherein, the air-output three-way seat comprises at least one air inlet located at an air-output side of the impeller, a first air outlet connected to the nozzle, a second air outlet connected to the nozzle, and an air-splitting wall body for splitting the airflow passing through the air inlet of the air-output three-way seat and then guiding the airflow to the first air outlet and the second air outlet, respectively, wherein, two ends of the nozzle body are connected to the first air outlet and the second air outlet, respectively.

In some embodiments, the air inlet of the air-output three-way seat is located at a first side of the air-output three-way seat, the air-splitting wall body is located in the center of a second side of the air-output three-way seat, the first air outlet and the second air outlet are located at two ends of the second side of the air-output three-way seat.

In some embodiments, the first air outlet and the second air outlet are exposed from two sides of the body, an air-output direction of the first air outlet and an air-output direction of the second air outlet are coaxial, and both perpendicular to an air-input direction of the air inlet of the air-output three-way seat.

In some embodiments, the air-splitting wall body is disposed based on a central axis of the air inlet of the air-output three-way seat, to equally divide the flowing area of the air inlet of the air-output three-way seat.

In some embodiments, the two sides of the air-splitting wall body respectively form a first guiding slope and a second guiding slope symmetric to each other, the first guiding slope guides a part of the airflow passing through the air inlet of the air-output three-way seat to the first air outlet, the second guiding slope guides a part of the airflow passing through the air inlet of the air-output three-way seat to the second air outlet.

In some embodiments, an inner wall of the air-output three-way seat is provided with a plurality of air-guiding pieces extending from the air inlet of the air-output three-way seat to the first air outlet or the second air outlet, respectively.

In some embodiments, an inner wall of the air-output three-way seat is provided with a plurality of air-guiding pieces extending from the air inlet of the air-output three-way seat to the second side of the air-output three-way seat, respectively.

In some embodiments, an inner wall of the air-output three-way seat is provided with a sunken air-guiding step extending from the first guiding slope to the first air outlet, the closer to the first air outlet, the larger the sunken distance of the sunken air-guiding step is;

the inner wall of the air-output three-way seat is provided with a sunken air-guiding step extending from the second guiding slope to the second air outlet, the closer to the second air outlet, the larger the sunken distance of the sunken air-guiding step is.

In some embodiments, projections at two ends of the air-splitting wall body extend to the air inlet of the air-output three-way seat in the second direction, respectively, to form a U-shaped and plate-shaped air-splitting wall.

In some embodiments, the airflow passes through an air-input shroud and the fan motor unit in sequence in a first direction, and then enters the nozzle, the airflow at least moves along a second direction opposite to the first direction and then is emitted out of the nozzle; the first direction is the gravity direction, the second direction is opposite to the gravity direction, the air inlet of the body is located on an upper portion of the body in the gravity direction, the air outlet of the body is located on a lower portion of the body in the gravity direction, the fan motor unit is located in an area between the air inlet of the body and the air outlet of the body.

The fan of the present disclosure can change the moving direction of airflow therein, decrease the entire volume and reduce the use cost of the fan.

BRIEF DESCRIPTION OF THE DRAWINGS

The foregoing and other features, and advantages of the invention are apparent from the following detailed description taken in conjunction with the accompanying drawings in which.

DETAILED DESCRIPTION

In the following, embodiments of the present disclosure will be described in detail with reference to the figures. The concept of the present disclosure can be implemented in a plurality of forms, and should not be understood to be limited to the embodiments described hereafter. In the contrary, these embodiments are provided to make the present disclosure more comprehensive and understandable, and so the conception of the embodiments can be conveyed to those skilled in the art fully. Same reference signs in the figures refer to same or similar members, so repeated descriptions of them will be omitted.

Figure 1:
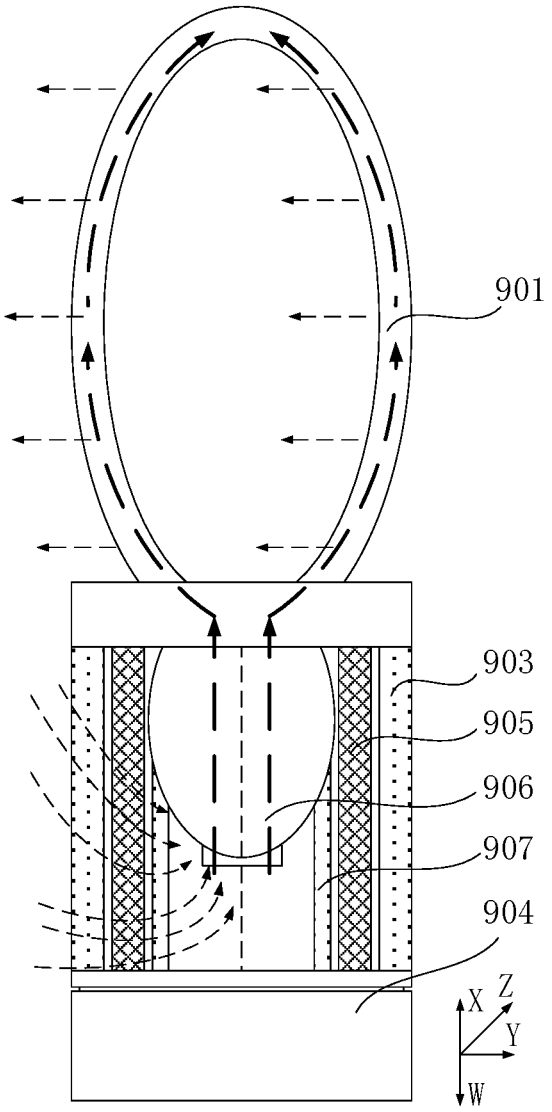
FIG. 1 (Prior Art)
FIG. 1 is a cross-sectional view of a bladeless fan in the prior art.
Figure 2:
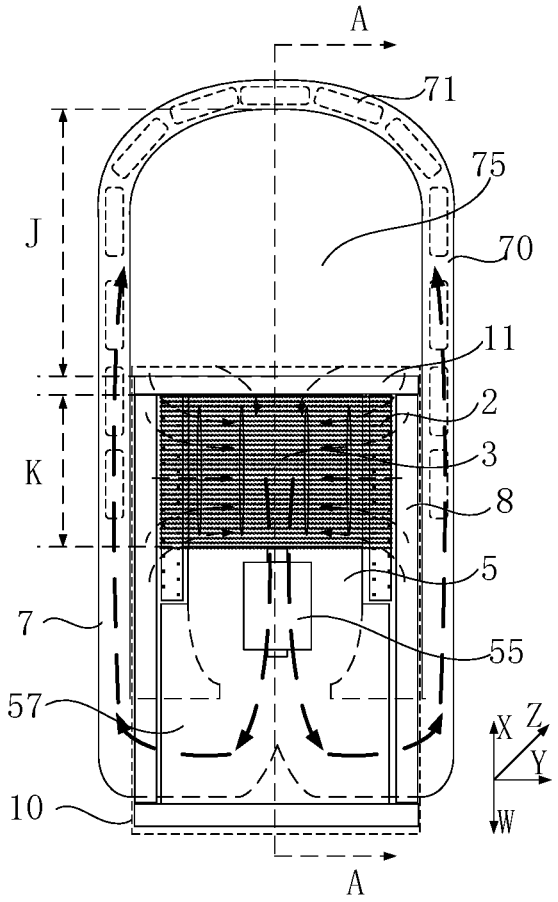
FIG. 2 is a schematic view of an inner air passage of a fan according to an embodiment of the present disclosure.
Figure 3:
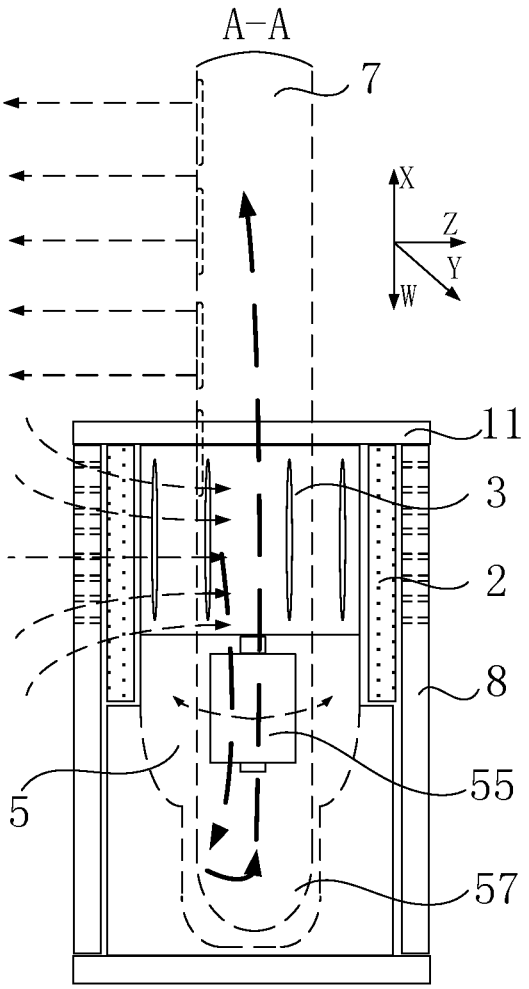
FIG. 3 is a cross-sectional view along A-A direction in FIG. 2.
Figure 17:
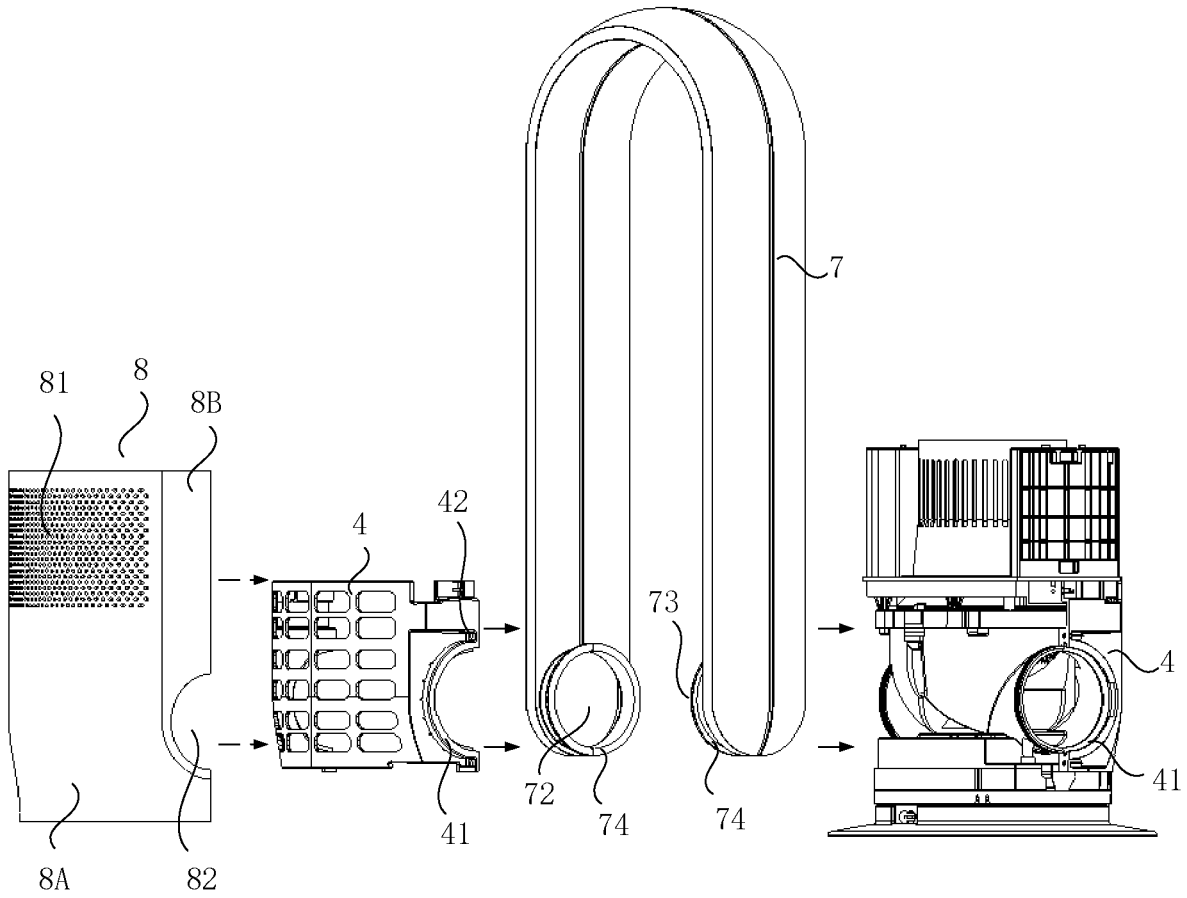
FIGS. 17-20 schematically show the mounting process of the fan according to the embodiment of the present disclosure.
Figure 18:
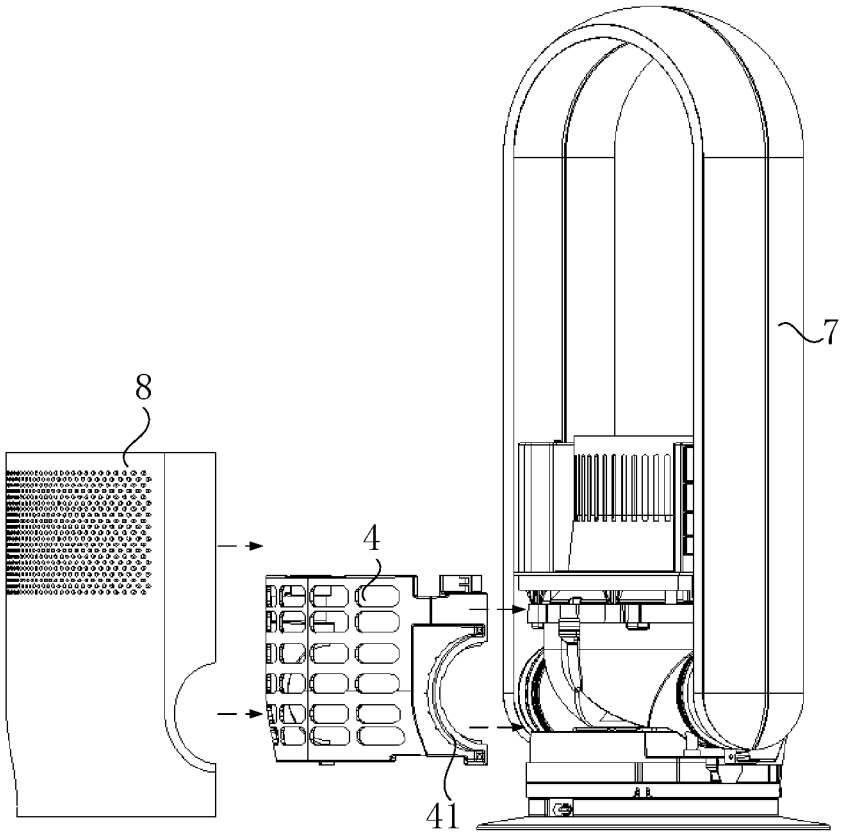
Figure 19:
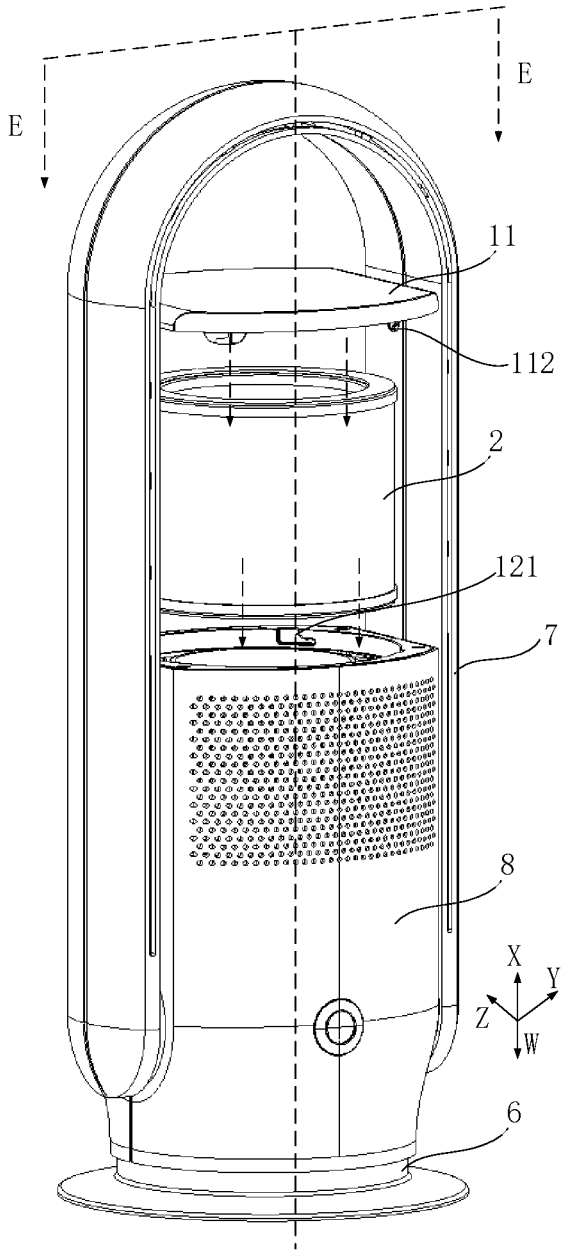

FIG. 2 is a schematic view of an inner air passage of a fan according to an embodiment of the present disclosure. FIG. 3 is a cross-sectional view along A-A direction in FIG. 2. As shown in FIGS. 2 and 3, the fan of the embodiment includes a body 10 for generating an airflow and a nozzle 7. Wherein, the body 10 at least includes a top cover 11, a filter 2, an air-input shroud 3 having air inlets, a fan motor unit 5 for generating the airflow, an outer housing 8 having air outlets and a nozzle 7. A first side 8A (shown in FIG. 17) of the outer housing 8 is provided with air-input holes 81. The filter 2 is located at a position, corresponding to the air-input holes 81, on an inner side of outer housing 8. The filter 2 is located upstream from the air-input shroud 3, and the filter 2 surrounds the air-input shroud 3. The air-input shroud 3 is located at the air inlets of the fan motor unit 5. The fan motor unit 5 makes the airflow pass through the body in a first direction W, wherein the first direction W is the gravity direction. The nozzle 7 is connected to the air outlet to receive the airflow from the body 10 and emit the airflow outward. Therefore, the airflow enters the nozzle 7 and is emitted out of the nozzle 7 at least after flowing in a second direction X opposite the first direction W. The second direction X is opposite to the gravity direction. The air inlets of the body 10 are provided on the air-input shroud 3 located in an upper portion of the body 10 in the gravity direction. The air outlets of the body 10 are located in a lower portion of a second side 8B (shown in FIG. 17) of the outer housing 8 of the body 10 in the gravity direction. The fan motor unit 5 is located in an area between the air inlets of the body 10 and the air outlets of the body 10. The nozzle 7 has at least one air-output passage extending in a direction parallel to the first direction W, the airflow passes through the air-output passage in the second direction X. The air passage of the fan provided by the present disclosure is designed completely different from the air passage in the prior art, the drawing direction of the fan motor unit 5 is inverted, the airflow is drawn from the upper portion of the body 10, passes through the fan motor unit 5 from top to bottom, then enters the nozzle 7 from the lower portion of the body 10. After the airflow flows through the nozzle 7 from bottom to top, the airflow is emitted outward from the air outlets 71 at different heights. In the present disclosure, the position of the fan motor unit 5 overlaps the position of the nozzle 7 in the first direction, so the entire height of the fan is decreased, the free space in the center of the nozzle 7 is fully utilized. Furthermore, suppose the height of the fan provided by the present disclosure is the same as the height of the fan in the prior art, the nozzle 7 of the present disclosure can be much bigger than the nozzle in the prior art, so the air supplying capability is greatly enhanced.

In an alternative embodiment, the nozzle 7 can be a tubular member extending in a perpendicular direction and located at one side of the body 10, a lower section of the tubular member can be rotatably connected to an opening of the body 10.

The nozzle 7 and the fan motor unit 5 can be arranged in parallel in a first direction W (or a second diction X). A projection of the nozzle 7 on a vertical plane at least partially overlaps a projection of the fan motor unit 5 on the same vertical plane. Therefore, the air outlets 71 of the nozzle 7 can be provided at the same horizontal height as the fan motor unit 5, or even lower than the horizontal height of the fan motor unit 5. In the present disclosure, the air passage is improved, to change the long flowing distance of the airflow when the airflow passes through the fan motor unit and the nozzle in sequence along a single direction to at least two short flowing distances having opposite directions. The two short flowing distances can be parallel to each other. Therefore, the industrial technical barriers that the fan motor unit and the nozzle must be arranged in sequence in the height direction are broken. The entire height of the fan is largely decreased, the center of the gravity of the product is lowered, and the stability of the product in a standing state is increased. Furthermore, the air inlets of the body at an upper position won't draw the dust from the ground during drawing air, the usage load of the filter is reduced, to reduce the replacement of the filter, and reduce the use cost of the bladeless fan.

The air outlets of the fan motor unit 5 are connected to two air-guiding passages, and the two air-guiding passages are respectively connected to openings on two sides of the body 10. The nozzle 7 has a nozzle body 70 in a shape of half a frame. The nozzle body 70 is bridge connected to a first surface of the body 10 facing toward the first direction W. Two ends of the nozzle body 70 are connected to the openings, respectively. The body 10 has at least one air-guiding passage, which can change the flowing direction of the airflow. The air-guiding passage extends in a third direction Y perpendicular to the first direction W, and respectively connects the air outlets of the fan motor unit 5 to the nozzle 7. In the embodiment, the fan motor unit 5, the air-guiding passage and the nozzle 7 together form at least one U-shaped combined air passage, but the present disclosure is not limited to this.

The nozzle body 70 is inverted U-shaped. The nozzle body 70 can rotate relative to the body 10 about an axis of the opening of the body 10 as the rotating shaft, so that the fan can output airflow in different directions. After the nozzle body 70 is rotated, although the airflow flowing along the nozzle body 70 is in a direction inclined relative to the vertical plane, the airflow still has a displacement in the second direction (opposite to the gravity direction) as the airflow enters a deeper portion of the nozzle body 70. The nozzle body 70 is provided with at least one air-output hole 71 opened in a fourth direction Z. The fourth direction Z is perpendicular to a plane formed by the first direction W and the third direction Y. The air-output holes 71 of the nozzle body 70 form an inverted U-shaped air passage, the air inlets of the body 10 are located in the scope of the inverted U-shaped air passage.

In a preferable embodiment, the nozzle body 70 has a first state and a second state. In the first state, the nozzle body 70 is bridge connected to the first surface of the body 10 facing toward the first direction W. After the nozzle body 70 rotates about the axis of the opening, the nozzle body 70 enters the second state. In the second state, the nozzle body 70 is away from a projection area of the filter 2 in the second section. When the nozzle body 70 is in the second state, the filter 2 can have an up and down displacement in the second diction to get in and out of the body 10 without contact with the nozzle body 70. A projection of the up and down displacement of the filter 2 in the second direction doesn't overlap a projection of the nozzle body 70 in the second direction when the nozzle body 7 is in the second state, so that the filter 2 can be detached and removed out of the body 10 in the second direction.

In a preferable embodiment, an accommodating space 75 has two replacing channels for the filter 2 getting in and out of the accommodating space 75 (the U-shaped nozzle body 70 naturally has two oversized openings connected to the inner accommodating space 75). The replacing channels extend in a direction perpendicular to the second direction. The filter 2 has a first displacement to get in and out of the accommodating space 75 from the body 10 in the second direction, and a second displacement to get in and out of the accommodating space 75 from the replacing channel. The height of the accommodating space 75 and the height J of the replacing channels are larger than the height K of the filter 2. The width of the accommodating space 75 and the width of the replacing channels are larger than the width of the filter 2.

Figure 4:
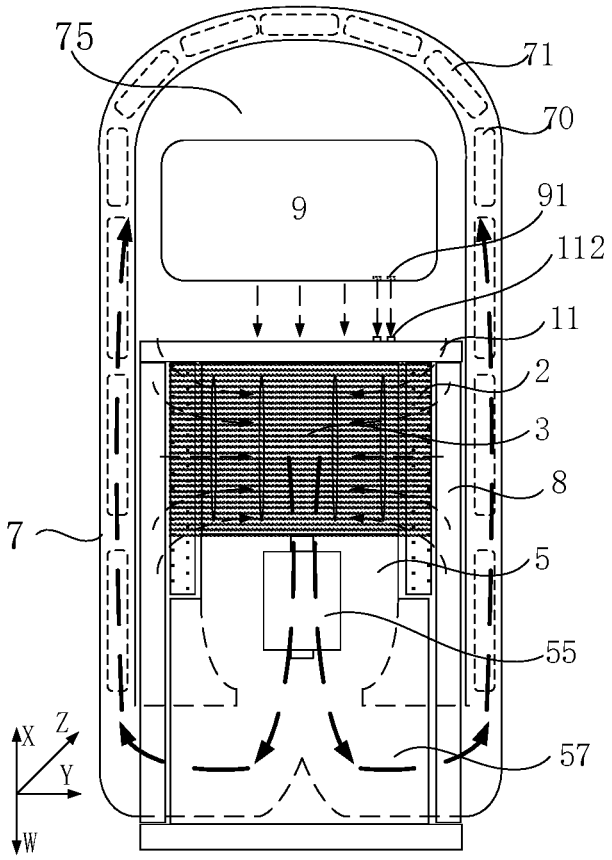
FIG. 4 is a schematic view of the fan connecting to a functional module according to the embodiment of the present disclosure.

FIG. 4 is a schematic view of the fan connecting to a functional module. As shown in FIG. 4, in the embodiment, the body 10 can be entirely disposed in the central area of the nozzle body 70. Furthermore, the central area of the nozzle 70 can be further utilized, to enhance the extended functions, that is, functional extended modules and the body 10 can be provided in the nozzle body 70 together. The first surface of the fan facing toward the first direction W and the first surface of the nozzle body 70 together form and surround the accommodating space 75. The accommodating space 75 is provided with at least one first connecting terminal 112. The fan can further include at least one functional extension member 9 located in the accommodating space 75, and at least one second connecting terminal 91 is connected to the first connecting terminal 112. For example, the first surface of the body 10 is provided with the first connecting terminal 112, the first surface of the body 10 supports the lower surface of the functional extension member 9. The second connecting terminal 91 is disposed on the lower surface of the functional extension member 9. The second connecting terminal 91 is aligned and electrically connected to the first connecting terminal 112 in the second direction. In a preferable embodiment, the second connecting terminal 91 is connected to the power supply circuit board in the fan base through wires, but the present disclosure is not limited to this.

In the embodiment, the functional extension member 9 can be at least one of the following: an electronic humidifier; an electronic aromatherapy machine, a LED lamp, an electronic mosquito repellent, an electronic display screen, a charging seat for mobile terminal charging, but the present disclosure is not limited to this. The functional extension member 9 can be a jetting member, and the air outlet of the jetting member is exposed to the accommodating space 75. The airflow emitted from the nozzle 7 flows through the air outlet of the jetting member, but the present disclosure is not limited to this. In a preferable embodiment, Coanda surface is provided at the air outlets arranged on the nozzle 7. An air passage is formed from the first side of the nozzle body 70 to a second side of the nozzle body 70 through the accommodating space 75 in the nozzle body 70 with the function of the Coanda surface. The air passage conveys a part of the air at one side of the nozzle body 70 to the air output side of the nozzle body 70. The air outlet of the jetting member is located in the scope of the air passage formed at the air outlets of the nozzle 7. The part of the air flowing through the nozzle body 70 flows through the air outlet of the jetting member, and the functional air emitted by the jetting member is mixed to the airflow emitted from the fan. For example, the functional extension member 9 is an electronic humidifier, the airflow emitted from the nozzle 7 flows through the air outlet of the electronic humidifier. The inner periphery of the nozzle 7 is provided with a plurality of air outlets opened toward the same side, the air outlets are provided with Coanda surface, to move a part of the air at one side of the nozzle body 70 to the air outlet side of the nozzle body 70, the part of the air passes through the air outlet of the electronic humidifier after passing through the nozzle body 70, to make the airflow emitted by the fan entirely moister. Therefore, the functions of the electronic humidifier and the fan are combined to enhance the humidify effect of the fan. In another embodiment, the functional extension member 9 can be an electronic aromatherapy machine, the airflow emitted by the nozzle 7 passes through the air outlet of the electronic aromatherapy machine. The air outlets having the Coanda surface can also be used to combine the functions of the electronic aromatherapy machine and the fan, to improve the smell in the room, and will not be described in detail. With the shape of the nozzle body 70, not only a channel for replacing the filter without moving the nozzle body 70 is provided, but also more functional air from the jetting member can be mixed to the airflow emitted from the fan with the help of the continuous Coanda surface formed at the circumferentially arranged air outlets, to combine different functions.

Figure 5:
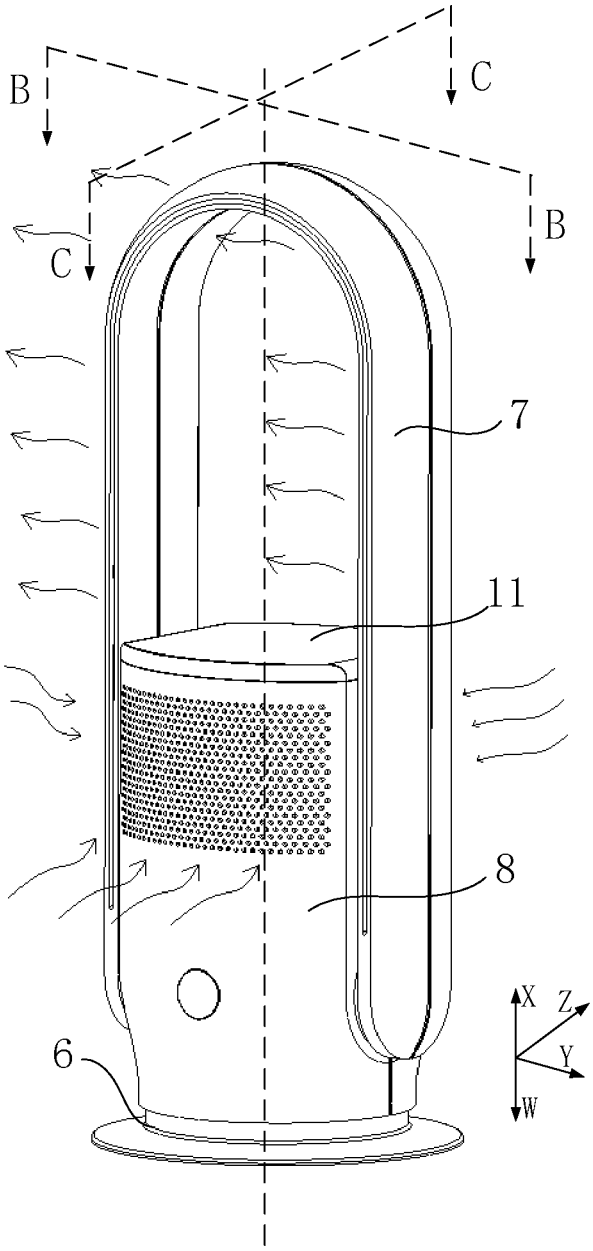
FIG. 5 is a stereogram of the fan according to the embodiment of the present disclosure.
Figure 6:
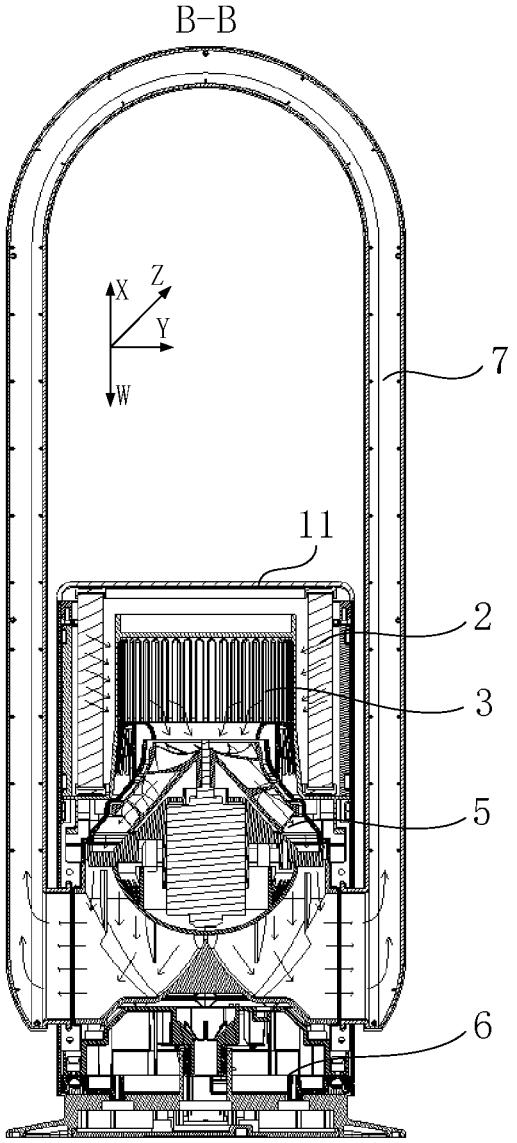
FIG. 6 is a cross-sectional view along B-B direction in FIG. 5.
Figure 7:
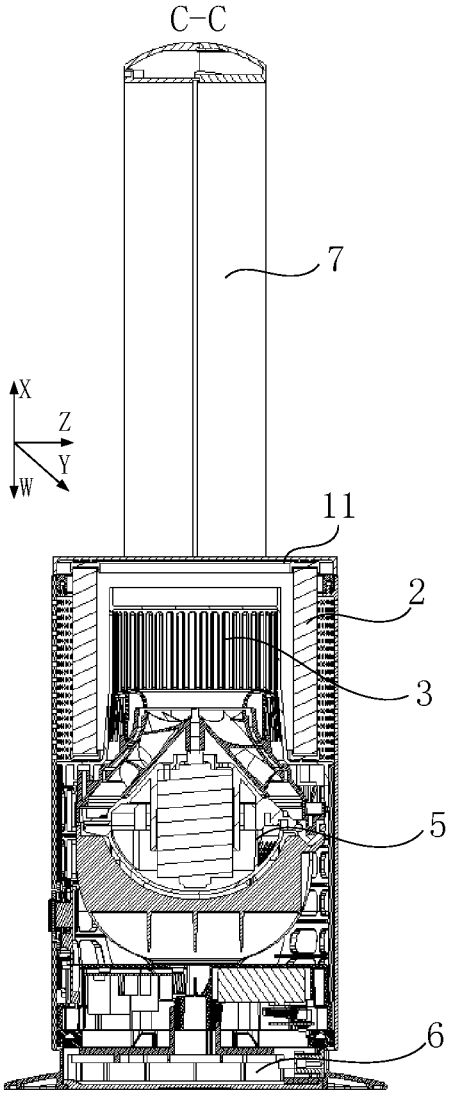
FIG. 7 is a cross-sectional view along C-C direction in FIG. 5.
Figure 8:
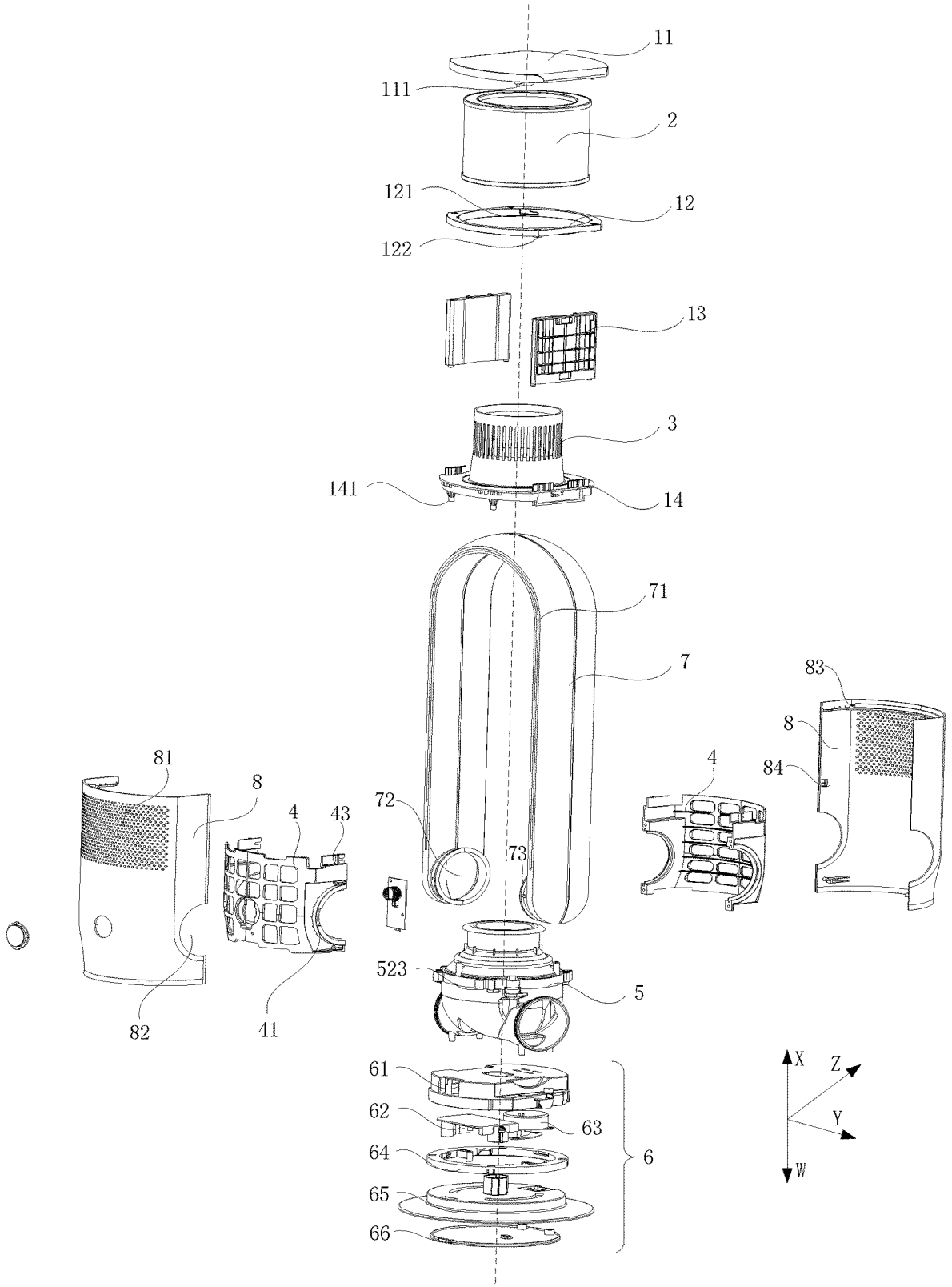
FIG. 8 is an exploded view of the fan according to the embodiment of the present disclosure.

FIG. 5 is a stereogram of the fan according to the embodiment of the present disclosure. FIG. 6 is a cross-sectional view along B-B direction in FIG. 5. FIG. 7 is a cross-sectional view along C-C direction in FIG. 5. FIG. 8 is an exploded view of the fan according to the embodiment of the present disclosure. As shown in FIGS. 5-8, in a preferable embodiment, the body of the fan includes the base 6, the fan motor unit 5 for generating the airflow, an air-input support 14, the air-input shroud 3 having the air inlets, the filter 2 and the top cover 11 arranged from bottom to top in the second direction X. Wherein, the base 6 includes a power-box upper cover 61, a power supply board 62, a rotating synchronous motor 63, a rotating support 64, a base 65 and a base cover 66. The rotation of the rotating synchronous motor 63 can drive the components located above and supported by the power-box upper cover 61, that is, the fan motor unit 5, the air-input shroud 3 and the nozzle 7 etc., to rotate horizontally without replacing their positions. In the present disclosure, the central area of the nozzle 7, which is not used in the prior art, is fully utilized, the body 10 is entirely disposed in the central area of the nozzle 7, the air inlets of the body 10 are within the scope of the inverted U-shaped air passage, to largely decrease the volume of the product, and decrease the cost of transporting and storing the product.

Two inner housings 4 capable of being aligned and engaged with each other are engaged together at two sides of the fan motor unit 5 and the base 6. After the inner housings 4 are engaged and screwed together, the fan motor unit 5 is limited at a position above the base 6. The sidewall on each end of each inner housing 4 is provided with a first catch 43, a screw hole 42 and a semicircle limiting slot 41 exposing an opening, the semicircle limiting slots 41 form an annular slot after the two inner housings are engaged together. The inner sides on two ends of the nozzle body 70 are provided with a first air inlet 72 and a second air inlet 73, respectively. The first air inlet 72 and the second air inlet 73 are connected to one opening, respectively.

Two outer housings 8 capable of being aligned and engaged with each other are engaged together at the outer periphery of the inner housings 4. The outer housings 8 covers the air-input shroud 3 and the fan motor unit 5. An area corresponding to the air-input shroud 3 of each outer housing 8 is provided with a plurality of air inlets 81 arranged in a mesh shape. The sidewall on each end of each outer housing 8 is provided with a second catch 84, a semicircle splicing portion 82 and a screw hole 83. Each second catch 84 of the outer housing 8 is engaged with one first catch 43 of the inner housing 4.

The lower surfaces of two side supporting frames 13 are connected to the air-input support 14. The upper surfaces of the side supporting frames 13 and the screw holes 83 on an upper end of the engaged outer housings 8 are connected through a screw hole 122 on an annular connecting frame 12. The inner side of the annular connecting frame 12 is provided with a positioning clamping slot 121. The height of the outer housing 8 is larger than the height of the fan motor unit 5. A space for accommodating the filter 2 and the air-input shroud 3 are provided between the two side supporting frames 13 above the engaged outer housings 8. A plurality of connecting columns 141 are provided on the lower surface of the air-input support 14. A plurality of connecting slots 523 are provided at an outer periphery of the fan motor unit 5. The connecting columns 141 are inserted in the connecting slots 523, the air-input shroud 3 is connected to an upper surface of the air-input support 14, so that the air-input shroud 3 can be connected to the air inlets of the fan motor unit 5 through the air-input support 14.

Figure 20:
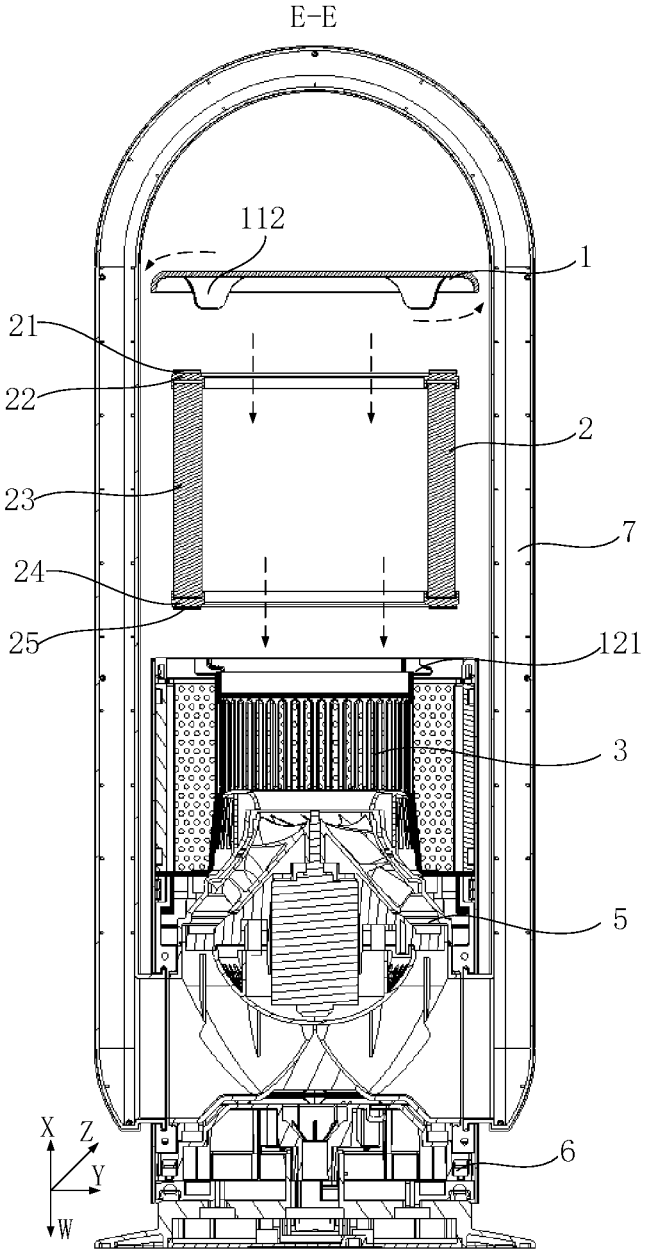

The filter 2 surrounds the air-input shroud 3. The filter 2 is disposed upstream from the air inlets of the air-input shroud 3. The filter 2 is a tubular air filter 23 (shown in FIG. 20), a first side of the tubular air filter 23 is provided with a first annular supporting frame 22 (shown in FIG. 20) for fixing a first annular sealing member 21 (shown in FIG. 20), the lower surface of the top cover 11 is provided with an inserting slot 56, and the inserting slot 56 can be detachably engaged with the first annular supporting frame 22.

The lower surface of the top cover 11 is provided with a positioning catch 111, which is detachably engaged in a rotation way with the positioning clamping slot 121 of the annular connecting frame 12. When the top cover 11 is engaged with the annular connecting frame 12, the top cover 11 and the air-input support 14 clamp the upper end surface and lower end surface of the filter 2. A second side of the tubular air filter 23 is provided with a second annular supporting frame 24 (shown in FIG. 29) for fixing a second annular sealing member 25 (shown in FIG. 20). The second annular supporting frame 24 is connected to the air-input support 14. The first side of the tubular air filter 23 is sealed with the top cover 11 through the first annular sealing member 21. The second side of the tubular air filter 23 is sealed with the air-input support 14 through the second annular sealing member 25. The first annular sealing member 21 and the second annular sealing member 25 are preferably made of memory sponge. The medium of the tubular air filter 23 can be made of existing air filter materials or air filter materials to be invented in the future, the present disclosure is not limited to this.

Figure 9:
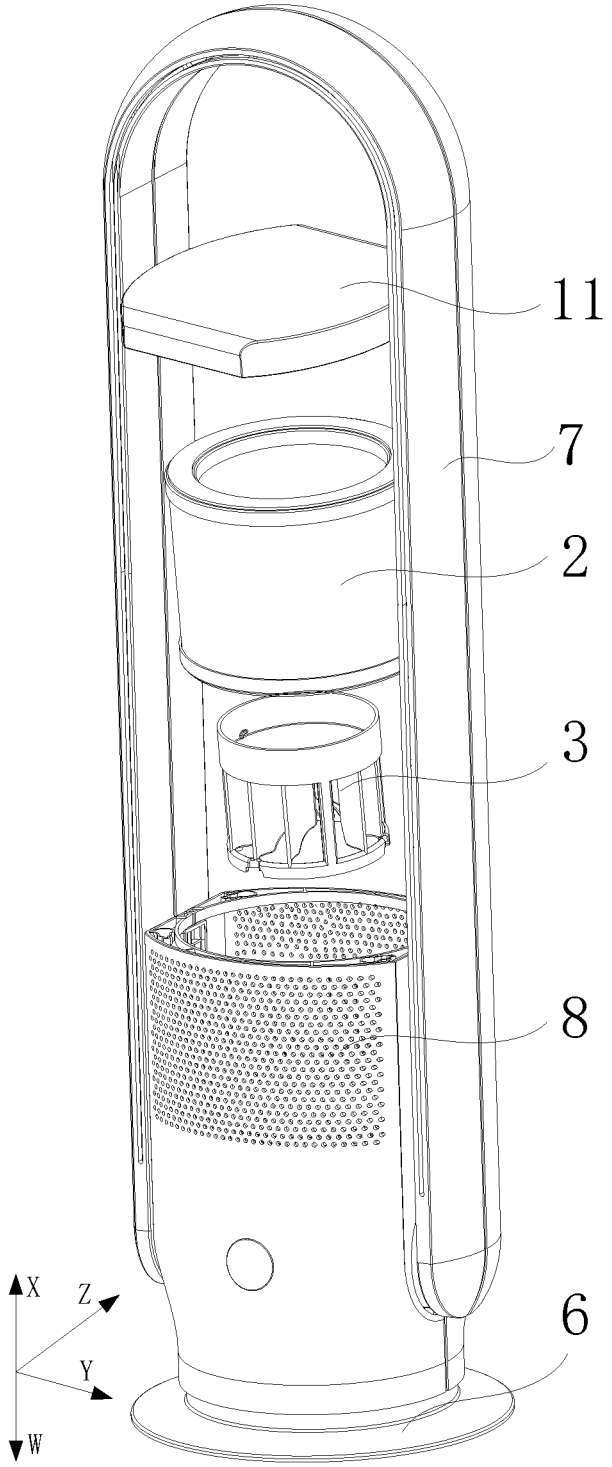
FIG. 9 is an exploded view of a part of the fan according to the embodiment of the present disclosure.
Figure 10:
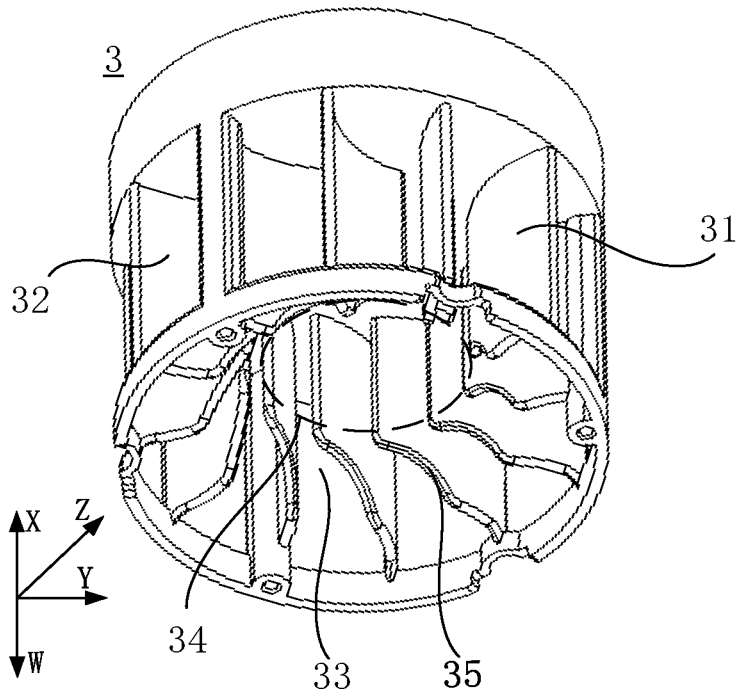
FIG. 10 is a stereogram of the air inlets of the fan according to the embodiment of the present disclosure.
Figure 11:
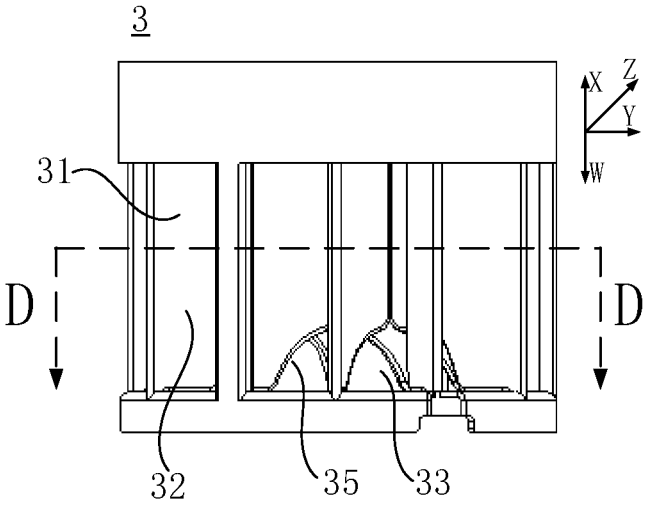
FIG. 11 is a schematic view of the air inlets of the fan according to the embodiment of the present disclosure.
Figure 12:
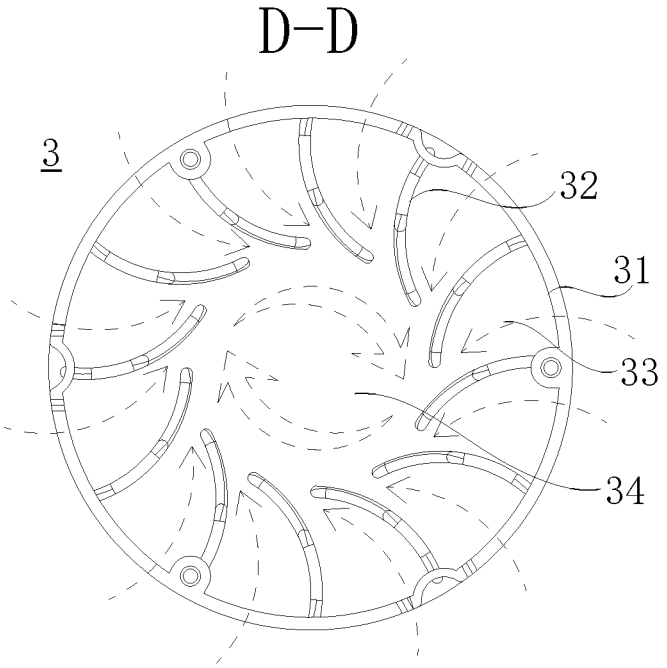
FIG. 12 is a cross-sectional view along D-D direction in FIG. 11.

FIG. 9 is an exploded view of a part of the fan according to the embodiment of the present disclosure. FIG. 10 is a stereogram of the air inlets of the fan according to the embodiment of the present disclosure. FIG. 11 is a schematic view of an air inlet of the fan according to the embodiment of the present disclosure. FIG. 12 is a cross-sectional view along D-D direction in FIG. 11. As shown in FIGS. 9-12, the body 10 of the fan provided by the embodiment is provided with the air-input shroud 3 having air inlets. The air-input shroud 3 is disposed downstream from the filter 2, and located in an annular area defined by the filter 2, to make the airflow filtered by the filter 2 enter the fan motor unit 5 through the air-input shroud 3. For the fan motor unit 5, the air-input shroud 3 is located upstream from the air inlets of the fan motor unit 5. The air-input shroud 3 can spoil the airflow entering the fan motor unit 5 to reduce noise. A plurality of wave-shaped spoilers 32 are provided at an outer periphery of the air-input shroud 3 in the first direction W. The wave-shaped spoilers 32 are arranged in circumferential direction of the air-input shroud 3 and at intervals. The wave-shaped spoilers 32 extend from the outer periphery toward the center of the air-input shroud 3. Air-input passages 33 are formed in the intervals between adjacent wave-shaped spoilers 32. The wave-shaped spoilers 32 can divide the airflow drawn in to a plurality of airflows for the first time, to achieve the effect of silencing and noise reduction. In the embodiment, the inner portion of the air-input shroud 3 is hollow to form a vortex passage 34, a first end of the vortex passage 34 is connected to the air-input passages 33 in a circumferential direction perpendicular to the first direction W, a second end of the vortex passage 34 is connected to the air inlets of the fan motor unit 5 in a second direction X, to reduce noises further. Along the connecting direction of the air-input passage 33, the two ends of the air-input passage 33 are provided with air inlets 31 exposed at the outer periphery of the air-input shroud 3 and a narrow slot connected to the vortex passage 34, to reduce the noise further.

In a preferable embodiment, in the connecting direction of the air-input passages 33, the closer to the vortex passage 34, the smaller the flow area of the air-input passages 33 are, and the closer to the air inlets 31, the larger the flow area of the air-input passages 33 are, to further reduce the noise.

In a preferable embodiment, a rotatable impeller 53 is provided in the fan motor unit 5. The protruding direction of the wave shape of each wave-shaped spoiler 32 is the same with a rotation direction of the impeller 53. The angles of the air-input passages 33 entering the vortex passage 34 are different from each other, to further reduce the noise.

In a preferable embodiment, a side of each wave-shaped spoilers 32 facing toward the air inlets of the fan motor assembly 5 is provided with a concave arc notch 35, to elongate the distance between the drawn air and the impeller, which also has the effect of reducing the noise.

Figure 13:
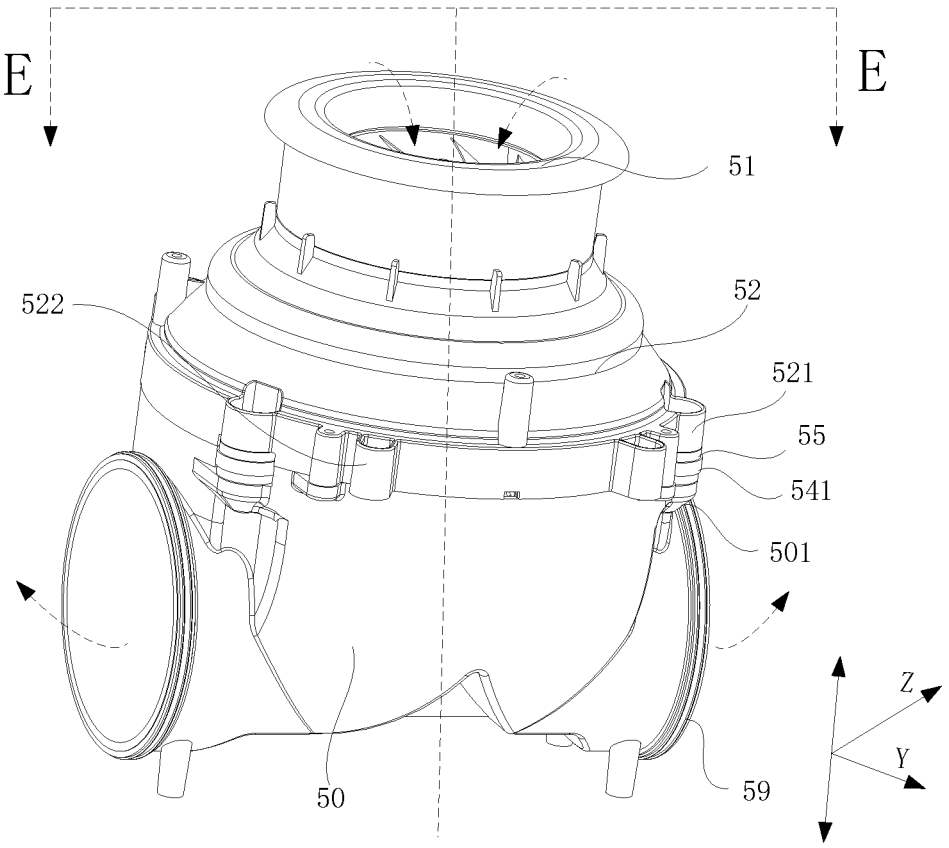
FIG. 13 is a stereogram of a fan motor unit of the fan according to the embodiment of the present disclosure.
Figure 14:
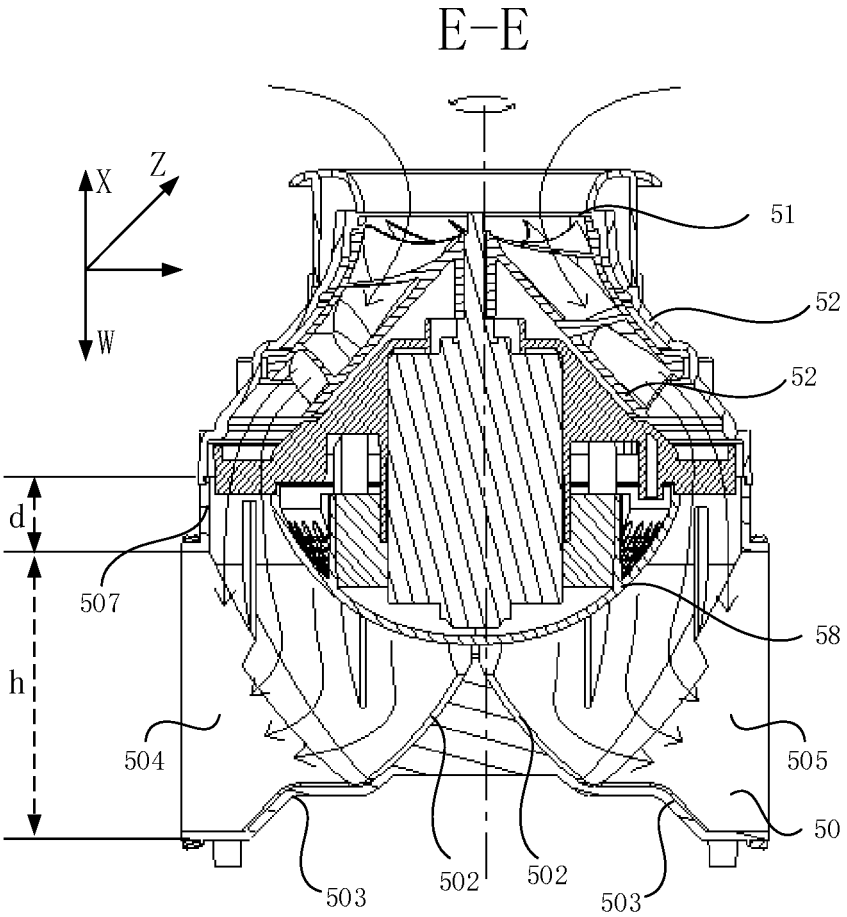
FIG. 14 is a cross-sectional view along E-E direction in FIG. 13.
Figure 15:
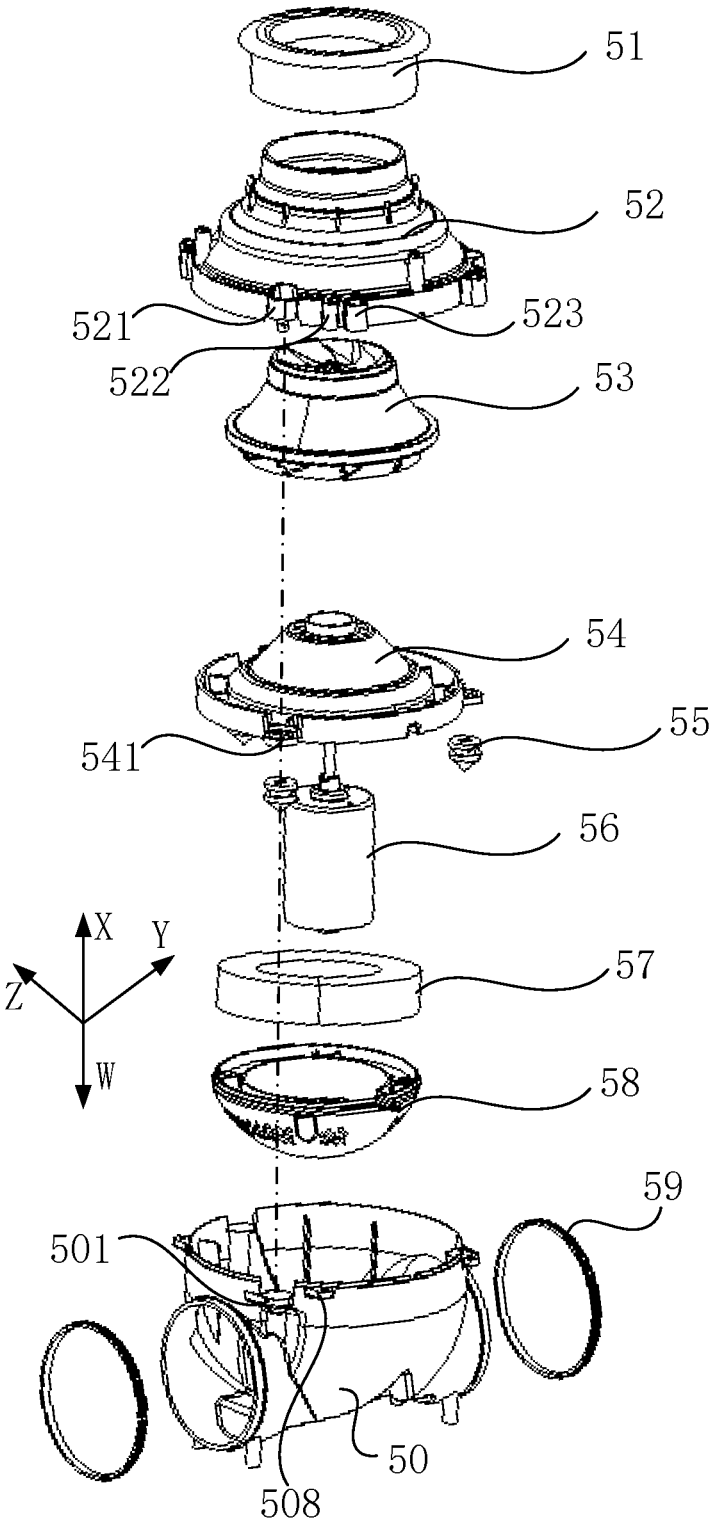
FIG. 15 is an exploded view of the fan motor unit of the fan according to the embodiment of the present disclosure.
Figure 16:
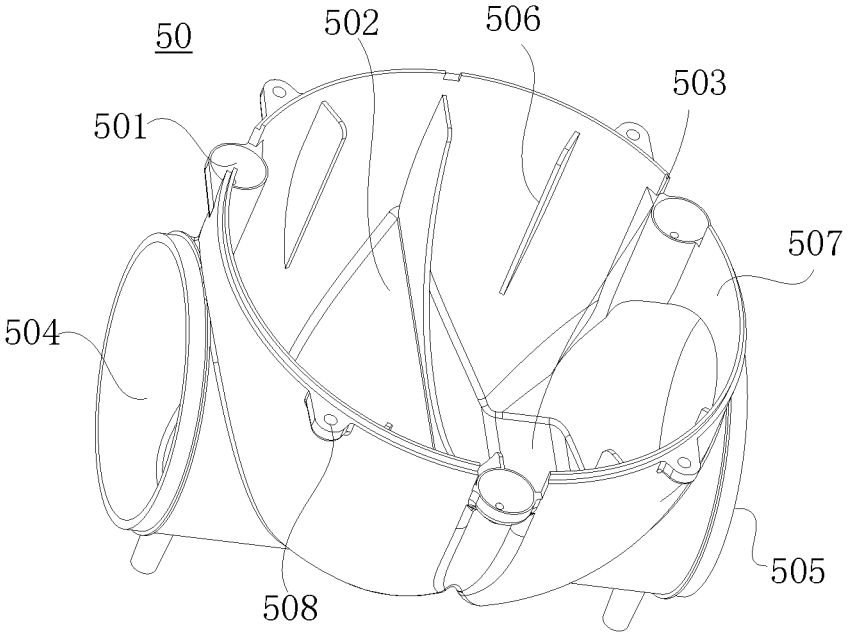
FIG. 16 is a stereogram of air-output three-way seat of the fan motor unit of the fan according to the embodiment of the present disclosure.

FIG. 13 is a stereogram of a fan motor unit of the fan according to the embodiment of the present disclosure. FIG. 14 is a cross-sectional view along E-E direction in FIG. 13. FIG. 15 is an exploded view of the fan motor unit of the fan according to the embodiment of the present disclosure. FIG. 16 is a stereogram of an air-output three-way seat of the fan motor unit of the fan according to the embodiment of the present disclosure. As shown in FIGS. 13-16, the fan motor unit 5 of the fan provided by the embodiment includes: an air-guiding opening shroud 51, an air-guiding shroud 52, the impeller 53, a motor support 54, a motor 56, a motor shroud 58 and an air-output three-way seat 50 assembled in sequence in the first direction W. The air-guiding opening shroud 51 seals and connects the vortex passage 34 of the air-input shroud 3 to the air-guiding shroud 52.

Wherein, the outer periphery surrounding the air-output three-way seat 50 is provided with a plurality of first positioning seat 501 and a plurality of first screw lugs 508. The motor 56 is located between the upper surface of the motor support 54 and the air-output three-way seat 50. A plurality of second positioning seat 541 surround the outer periphery of the air-guiding shroud 52. The air-output three-way seat 50 is screwed to the air-guiding shroud 52. After each second positioning seat 541 of the motor support 54 is connected to one first positioning seat 501 and one third positioning seat 521 through a flexible connecting piece, the second positioning seat 541 is clamped and limited between the first positioning seat 501 and the third positioning seat 521. Therefore, the motor support 54 is not fixed, but limited between the air-guiding shroud 52 and the air-output three-way seat 5—by the flexible connecting pieces at a same horizontal plane. That is to say, the motor support 54 is suspended between the air-guiding shroud 52 and the air-output three-way seat 50. The flexible connecting piece and each positioning seat together form a vibration absorber, so that the motor support 54 won't contact with the air-guiding shroud 52 and the air-output three-way seat 50 during vibration. The vibration is transmitted by the contacting points of the vibration absorber, to largely reduce the noise and keep the stability of the fan.

In the embodiment, the top surface of the positioning vibration-damping pad 55 can be a flat surface, to transform the upward vibration generated by the dynamical system to a planar motion, to balance the vibration. The lower portion of the positioning vibration-damping pad 55 can be in a conical shape, and the bump of the conical shape contacts with other surfaces, to reduce the contact area and achieve the effect of reducing vibration. The center of the positioning vibration-damping pad 55 has a hollow blind hole. Therefore, the positioning vibration-damping pad 55 can be elastically deformed based on the central blind hole when the dynamical system generates vibration, to reduce the vibration. After the blind hole is assembled to the upper support, a sealed hollow hole is formed, to keep the air in the blind hole, so that the positioning vibration-damping pad can return quickly from its elastic deformation under the function of air pressure during vibration.

In a preferable embodiment, the first positioning seats 501, the second positioning seats 541 and the third positioning seats 521 are provided with coaxial through holes, respectively. Each flexible connecting piece is a positioning vibration-damping pad 55 in a nail shape. The positioning vibration-damping pad 55 passes through and clamps the through holes of the first positioning seat 501, the second positioning seat 541 and the third positioning seat 521. The positioning vibration-damping pad 55 includes a rod portion, and an outward-expansion conical platform and an outward-expansion shoulder platform located at two ends of the rod portion, a maximum diameter of the outward-expansion conical platform and a maximum diameter of the outward-expansion shoulder platform are both larger than a diameter of the rod portion. The rod portion passes through the through holes of the first positioning seat 501, the second positioning seat 541 and the third positioning seat 521, to clamp the first positioning seat 501, the second positioning seat 541 and the third positioning seat 521 between the outward-expansion conical platform and the outward-expansion shoulder platform. The positioning vibration-damping pad 55 is provided with a hollow blind hole in the first direction W and along an axial direction. The hollow blind hole at least extends from the outward-expansion conical platform to the rod portion, or the hollow blind hole at least extends from the outward-expansion conical platform to the outward-expansion shoulder platform.

In a preferable embodiment, an annular motor silencing cotton 57 surrounding the outer periphery of the motor 56 is provided between the motor support 54 and the air-output three-way seat 50. The noise caused for the high-speed rotation of the motor and the impeller is further reduced.

In the embodiment, the air-output three-way seat 50 includes an air inlet 507 at an air-output side of the impeller, a first air outlet 504 connected to the nozzle 7, a second air outlet 505 connected to the nozzle 7, and an air-splitting wall body 502. The air-splitting wall body 502 is used for splitting the airflow passing through the air inlet 507 and guiding the airflow to the first air outlet 504 and the second air outlet 505. The two ends of the nozzle body 70 are connected to the first air outlet 504 and the second air outlet 505, respectively. The air inlet 507 is located at a first side of the air-output three-way seat 50, the air-splitting wall body 502 is located in the center of a second ide of the air-output three-way seat 50. The first air outlet 504 and the second air outlet 505 are located at two ends of the second side of the air-output three-way seat 50. The first air outlet 504 and the second air outlet 505 are exposed out of the two sides of the body 10. The air-output direction of the first air outlet 504 and the air-output direction of the second air outlet 505 are coaxial, and both perpendicular to the air-input direction of the air inlet 507. The two sides of the air-splitting wall body 502 respectively form a first guiding slope and a second guiding slope symmetric to each other. The first guiding slope guides a part of the airflow passing through the air inlet 507 to the first air outlet 504, the second guiding slope guides a part of the airflow passing through the air inlet 507 to the second air outlet 505. The projections at two ends of the air-splitting wall body 502 extend to the air inlet 507 in the second direction X, respectively, to form a U-shaped and plate-shaped air-splitting wall. Therefore, the airflow passing through the air inlet 507 can be split while reducing the noise. In the embodiment, the air-splitting wall body 502 is disposed based on a central axis of the air inlet 507, to equally divide the flowing area of the air inlet 507. The inner wall of the air-output three-way seat 50 is provided with a plurality of air-guiding pieces 506 extending from the air inlet 507 to the second side of the air-output three-way seat 50, respectively, but the present disclosure is not limited to this. The inner wall of the air-output three-way seat 50 is provided with a sunken air-guiding step extending from the first guiding slope to the first air outlet 504. The closer to the first air outlet 504, the larger the sunken distance of the sunken air-guiding step is. The inner wall of the air-output three-way seat 50 is provided with a sunken air-guiding step 503 extending from the second guiding slope to the second air outlet 505. The closer to the second air outlet 505, the larger the sunken distance of the sunken air-guiding step 503 is, to reduce the noise generated when the airflow turns, and provide a space for the base 6, but the present disclosure is not limited to this. In the present disclosure, the air-output three-way seat 50 integrates the air-guiding function and the air-splitting function together, thereby largely reducing the height of the fan motor assembly 5, and further decreasing the total height and volume of the entire fan.

In a preferable embodiment, the inner wall of the air-output three-way seat 50 is provided with a plurality of air-guiding pieces extending from the air inlet 507 to the first air outlet 504 or the second air outlet 505, respectively, and the present disclosure is not limited to this.

The air inlet 507 is a mouth of an annular tube, a distance between the mouth of the annular tube and the first air outlet 504 or the second air outlet 505 in the first direction W is d, a diameter of the first air outlet 504 and the second air outlet 505 is h, a ratio d/h ranges from 2.0 to 3.5. After the airflow generated from impeller 53 enters the air inlet 507 of the air-output three-way seat 50, the airflow will turn the flowing direction at an angle of at least 90° in a very short distance. If the ratio d/h is too small, the air pressure of the airflow will be decreased, the air-output will be reduced, and the air supplying distance will be shortened. If the ratio d/h is too big, vortex negative pressure will be generated, turbulence will be formed and thereby causing a lot of noise.

In a preferable embodiment, the range of the ratio d/h is one of the following ranges: 2.1-3.4, 2.2-3.3, 2.3-3.2, 2.4-3.1, 2.5-3.0, 2.6-2.9, 2.7-2.8.

In a preferable embodiment, the ratio d/h is 2.7.

FIGS. 17-20 schematically show the mounting process of the fan according to the embodiment of the present disclosure. As shown in FIGS. 17-20, the mounting process of the fan provided by the embodiment is: firstly, the air-input shroud 3, the air-input support 14, the fan motor unit 5 and the base 6 are connected through the first inner housing 4. The nozzle 7 having two annular shoulder platforms 74 at two ends is inserted in a horizontal direction to the semicircle limiting slot 41 exposed from the inner housing 4. Therefore, the first air inlet 72 and the second air inlet 73 of the annular shoulder platforms 74 are respectively connected to the first air outlet 504 and the second air outlet 505 of the air-output three-way seat 50 of the fan motor unit 5, and sealed through a sealing ring 59. Then, the second inner housing 4 and the first inner housing 4 are engaged and screwed through the screw hole 42, to clamp the annular shoulder platforms 74 in the annular slots formed by the assembly of the two semicircle limiting slots, so that the nozzle 7 can rotate based on the annular slot. Then, the two outer housings 8 are snap-fit at the outer periphery of the inner housing 4, the side supporting frame 13 is mounted, then the upper end of the side supporting frame 13 and the upper end of the outer housing 8 are screwed together through the annular connecting frame 12. At last, the filter 2 is put in the space between the inner wall of the outer housing 8 and the outer periphery of the air-input shroud 3. The filter 2 is sealed and clamped between the top cover 11 and the air-input support frame 14 through the rotating locking between the top cover 11 and the annular connecting frame 12.

The mounting way of the present disclosure is different from the existing way of sleeving the nozzle 7 on the body in a vertical direction. The mounting way of the present disclosure is benefit for the sealing of the air passage, and reduces the mounting difficulty.

To sum up, the purpose of the present disclosure is to provide a fan, which can change the moving direction of the airflow, the entire volume of the fan is decreased, and the use cost is reduced.

The above is a detailed description of the present disclosure in connection with the specific preferred embodiments, and the specific embodiments of the present disclosure are not limited to the description. Modifications and substitutions can be made without departing from the spirit and scope of the present disclosure.

What is claimed is:

1. A fan comprising: a body comprising at least one first air inlet and a fan motor unit for generating an airflow, wherein the fan motor unit comprises an impeller, a motor and an air-output three-way seat; and a nozzle connected to the body, wherein the nozzle is configured to receive the airflow from the body and emit the airflow, the nozzle comprises a nozzle body and at least one third air outlet, and the nozzle body is inverted U-shaped; wherein, the air-output three-way seat comprises at least one second air inlet located at an air-output side of the impeller, a first air outlet connected to the nozzle, a second air outlet connected to the nozzle, and an air-splitting wall body for splitting the airflow passing through the at least one second air inlet of the air-output three-way seat and then guiding the airflow to the first air outlet and the second air outlet, respectively, wherein, two ends of the nozzle body are connected to the first air outlet and the second air outlet, respectively; wherein, the airflow passes through an air-input shroud and the fan motor unit in sequence in a gravity direction, and then enters the nozzle, wherein within the nozzle, the airflow at least moves along a direction opposite to the gravity direction and then is emitted out of the nozzle; the at least one first air inlet of the body is located on an upper portion of the body in the gravity direction, the first and second air outlets of the body are located on a lower portion of the body in the gravity direction, the fan motor unit is located in an area between the at least one first air inlet of the body and the first and second air outlets of the body, a position of the fan motor unit overlaps a position of the nozzle in the gravity direction, the motor is located above the air-output three-way seat in the gravity direction, and an axis of the motor and an axis of the at least one first second air inlet extend in the gravity direction.

2. The fan according to claim 1, wherein, the at least one second air inlet of the air-output three-way seat is located at an upper side of the air-output three-way seat, the air-splitting wall body is located in the center of a lower side of the air-output three-way seat, the first air outlet and the second air outlet are located at two ends of the lower side of the air-output three-way seat.

3. The fan according to claim 1, wherein, the first air outlet and the second air outlet are disposed at two sides of the body, wherein, an air-output direction of the first air outlet and an air-output direction of the second air outlet are coaxial and are both perpendicular to an air-input direction of the at least one second air inlet of the air-output three-way seat.

4. The fan according to claim 1, wherein, the air-splitting wall body is disposed on a central axis of the at least one second air inlet of the air-output three-way seat, to equally divide a flowing area of the at least one second air inlet of the air-output three-way seat.

5. The fan according to claim 1, wherein, a side facing the first air outlet and a side facing the second air outlet of the air-splitting wall body respectively form a first guiding slope and a second guiding slope symmetric to each other, the first guiding slope guides a part of the airflow passing through the at least one second air inlet of the air-output three-way seat to the first air outlet, the second guiding slope guides a part of the airflow passing through the at least one second air inlet of the air-output three-way seat to the second air outlet.

6. The fan according to claim 5, wherein, an inner wall of the air-output three-way seat is provided with a plurality of air-guiding pieces extending from the at least one second air inlet of the air-output three-way seat to the first air outlet or the second air outlet, respectively.

7. The fan according to claim 5, wherein, an inner wall of the air-output three-way seat is provided with a plurality of air-guiding pieces extending from the at least one second air inlet of the air-output three-way seat to a lower side of the air-output three-way seat, respectively.

8. The fan according to any item of claim 5, wherein, a first sunken air-guiding step extends from the first guiding slope to the first air outlet, wherein the first sunken air-guiding step is formed such that the closer the first sunken air-guiding step gets to the first air outlet, the larger a sunken distance of the first sunken air-guiding step becomes;

a second sunken air-guiding step extends from the second guiding slope to the second air outlet, wherein the second sunken air-guiding step is formed such that the closer the second sunken air-guiding step gets to the second air outlet, the larger a sunken distance of the second sunken air-guiding step becomes.

9. The fan according to claim 1, wherein, projections at two ends of the air-splitting wall body extend to the at least one second air inlet of the air-output three-way seat in a direction opposite to the gravity direction, respectively, to form a U-shaped and plate-shaped air-splitting wall.

* * * * *